US005691677A

United States Patent [19]

De Maron et al.

[11] Patent Number: 5,691,677

[45] Date of Patent: Nov. 25, 1997

[54] TUNABLE RESONATOR FOR MICROWAVE OSCILLATORS AND FILTERS

[75] Inventors: Lino De Maron, Cassano d'Adda; Riccardo Urciuoli, Pessano con Bornago, both of Italy

[73] Assignee: Italtel spa, Milan, Italy

[21] Appl. No.: 586,648

[22] PCT Filed: Jul. 1, 1994

[86] PCT No.: PCT/EP94/02154

§ 371 Date: Jun. 12, 1996

§ 102(e) Date: Jun. 12, 1996

[87] PCT Pub. No.: WO95/01658

PCT Pub. Date: Jan. 12, 1995

[30] Foreign Application Priority Data

Jul. 2, 1993 [IT] Italy ..... MI93A1431

[51] Int. Cl.[6] ..... H01P 7/10

[52] U.S. Cl. ..... 333/219.1; 333/235

[58] Field of Search ..... 333/219, 219.1, 333/235, 202

[56] References Cited

U.S. PATENT DOCUMENTS

| | | | |
|---|---|---|---|
| 4,028,652 | 6/1977 | Wakino et al. . | |
| 4,459,570 | 7/1984 | Delaballe et al. | 333/219.1 |
| 4,620,168 | 10/1986 | Delestre et al. | 333/219.1 |
| 4,956,617 | 9/1990 | Bowlds | 333/219.1 |
| 5,008,640 | 4/1991 | Accatino et al. | 333/219.1 |
| 5,097,238 | 3/1992 | Sato et al. | 333/219.1 |

FOREIGN PATENT DOCUMENTS

| | | | |
|---|---|---|---|
| 346806 | 12/1989 | European Pat. Off. | 333/202 DR |
| 351840 | 1/1990 | European Pat. Off. . | |
| 57-150230 | 9/1982 | Japan | 333/219.1 |
| 58-111409 | 7/1983 | Japan | 333/202 DR |
| 59-176905 | 10/1984 | Japan | 333/219.1 |
| 61-270902 | 12/1986 | Japan | 333/219.1 |
| 2-241105 | 9/1990 | Japan | 333/219.1 |
| 1524112 | 11/1989 | U.S.S.R. | 333/202 DR |
| 1520473 | 8/1978 | United Kingdom . | |

OTHER PUBLICATIONS

Snyder, R.V., "Dielectric Filters with Wide Stopbands", IEEE Transactions on Microwave Theory and Techniques, p.2100–2103(Nov. 92).

"Dielectric Resonators", ed. Darko Kajfez and Pierre Guillon, ARTECH House Inc., 1986, index and pp.3,138, 161–164, 1986.

*Primary Examiner*—Benny Lee
*Assistant Examiner*—Darius Gambino
*Attorney, Agent, or Firm*—Herbert L. Lerner; Laurence A. Greenberg

[57] ABSTRACT

A tunable microwave resonator, including walls delimiting a cavity, the walls including a first wall formed with an opening; a tuning screw extending in the opening, a cylindrical dielectric resonator disposed in the cavity, and a dielectric support projecting in the opening, the dielectric support acting as a spacer and rigidly connecting the dielectric resonator to the tuning screw. The cavity and the dielectric resonator are excitable in one or more resonant modes of an electromagnetic field, wherein a current induced by the resonant modes is transferred outside the cavity; and a toroidal extension formed on the first wall inside the cavity and surrounding the opening, the toroidal extension extending a given length inside the cavity, the toroidal extension reducing a thermal effect on the resonance frequency, and increasing mechanical stability.

23 Claims, 3 Drawing Sheets

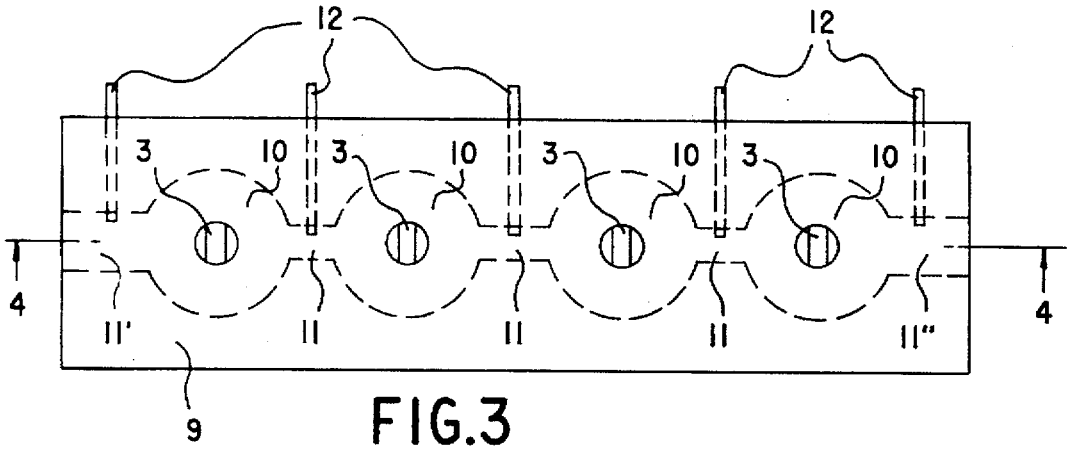
FIG.3
FIG.4
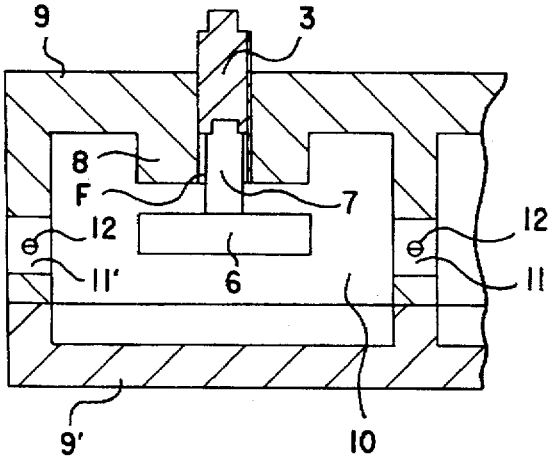
FIG.5
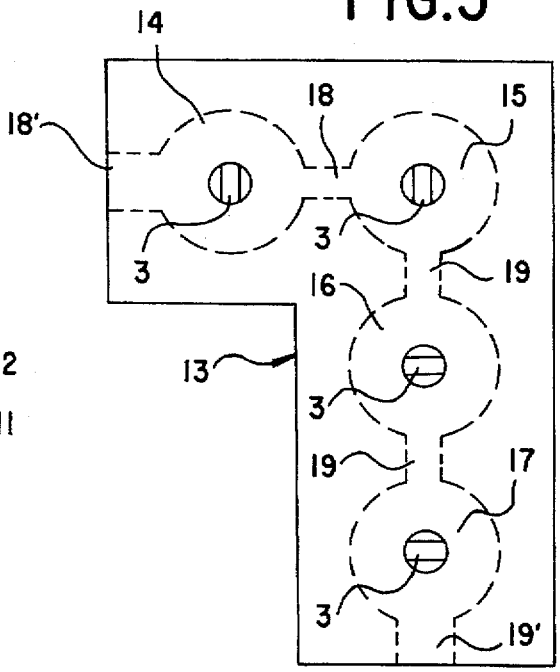
FIG.6
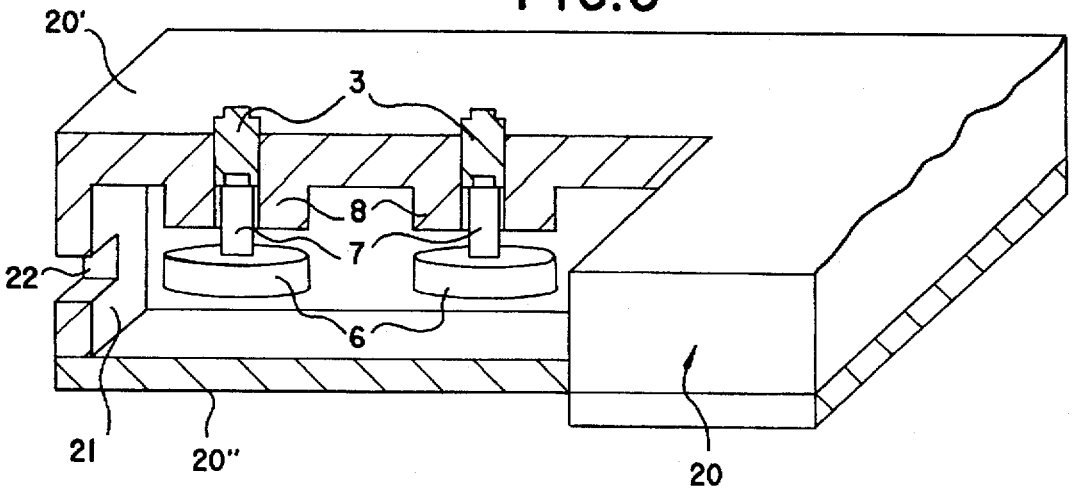

TUNABLE RESONATOR FOR MICROWAVE OSCILLATORS AND FILTERS

BACKGROUND OF THE INVENTION

The present invention relates to the field of microwave resonators and specifically a tunable resonator for microwave oscillators and filters.

DESCRIPTION OF THE RELATED ART

As known, the more conventional microwave resonators consist of simple cavities enclosed by metal walls. With the appearance of low-loss ceramic materials it has become possible to use in the microwave resonators dielectric bodies of varying forms of which the most widely used is cylindrical. The operation of dielectric resonators, also termed DR below, is based essentially on the reflection phenomenon which an electromagnetic wave undergoes when it strikes the separation surface between two materials having different dielectric constants.

Theoretically, it is not necessary to enclose the dielectric resonators in metal walls because the resonance frequencies of the excited modes depend principally on the geometrical form and dimensions of the resonator. In practice however, to avoid irradiation of electromagnetic energy and to obtain physically usable devices the DRs are positioned in closed metal cavities.

The use of ceramic materials with high dielectric constant has made very advantageous the use of dielectric resonators in the realisation of microwave filters and oscillators. Indeed, since because of the high dielectric constant the electromagnetic field tends to remain confined mostly with the DRs, it has been possible to reduce the sizes and obtain greater miniaturisation of the circuits. In addition, the low temperature coefficients of the ceramic ensure greater temperature stability in comparison with circuits employing conventional resonators.

In view of the above, a microwave filter provided by using dielectric resonators in accordance with the known art comprises generally a metal cavity in which are located one or more cylindrical dielectric resonators arranged in accordance with an appropriate direction. Coupling between the filter and external circuits is achieved by means of various devices, e.g. coaxial probes, loops, irises, wave guide sections, etc., whose position and orientation are designed to optimise performance for the resonant mode used.

It is also known that in industrial applications of filters it is often essential to be able to change the resonance frequency of the individual dielectric resonators with a tuning operation simple to implement, e.g. to be able to recover the resonance frequency changes caused by machining tolerances.

For this purposes two different tuning methods are known for dielectric resonators.

A first method consists of modifying the volume of the metal cavity containing the dielectric resonators at points where the energy density of the resonant mode is high. The resulting deformation of the electromagnetic field present outside the DR causes a change of resonance frequency of the resonant modes excited in the resonators. From the theory it is known that the resonance frequency of an electromagnetic mode in a cavity increases when the volume of the cavity is reduced by a quantity dV if in the volume dV the energy of the electric field predominates in relation to the magnetic field and decreases in the contrary case. The amount of the frequency variation is proportional to dV and to the difference between the local electrical and magnetic energies. This amount depends thus on the mode considered and the point where the cavity deforms.

In practice, the change in volume of the cavity is achieved by introducing into the cavity metallic material in the form of screws or plates such as for example in the resonator described in U.S. Pat. No. 5,008,640 in which the tuning is changed by introducing screws in the side wall of the metal cavity.

The main disadvantage of this first tuning method lies in the fact that in order for the tuning achieved to be sufficient it is necessary to act where the energy density of the mode to be tuned is highest. This in the generality of cases is not always easy nor effective. A second disadvantage is that the current induced on the surfaces of the elements introduced in the cavity cause a loss of power of the resonant mode used. In addition introduction of metal elements in the cavity can originate undesirable spurious responses.

A second DR tuning method consists of varying the volume of the dielectric resonators. In this manner are modified considerably the resonance frequencies of all the resonant modes present in the dielectric resonators in a manner depending on the dielectric constant from the point where the volume is changed and on the amount of the change.

A first known application of this second method consists of changing the mutual distance between two dielectric resonators placed in the same cavity.

A second known application of this second tuning method consists of using cylindrical dielectric resonators having a hole in axial direction in which is introduced a metal tuning screw as for example in the tunable resonator described in the patent U.S. Pat. No. 4,630,012 or in which is introduced a small dielectric cylinder as for example in the tunable resonator described in the U.S. Pat. No. 4,810,984.

The main disadvantage of this second tuning method is that it is onerous. Indeed, in the case of the first application of the method it is necessary to use a second resonator while in the second application it is necessary to perform sophisticated machining in the body of the dielectric resonators.

A third tuning method consists of varying the position of the dielectric resonator inside the resonating cavity by moving it near or away a cavity wall. An example of utilization of the last tuning method is given in the pass-band filter disclosed in the document EP-A-0346806. Said filter consists of a waveguide including dielectric resonators aligned along the centre line of the guide and regularly spaced, characterized in that each dielectric resonator is integral with a dielectric screw penetrating into a wall of the cavity for varying the position of the resonator into the waveguide, thereby adjusting the frequency of resonance of the resonator.

In the case of tunable resonators and filters which use moving DRs they can also show mechanical drawbacks, especially if during their use they are subjected to strong stresses, as certainly takes place in the space field. These drawbacks consist mainly of detachment of the DRs from their supports because of the arise of mechanical vibrations.

Both known tuning methods also require for the purpose of ensuring temperature stability of a resonator or filter on which said methods operate a careful selection of the materials constituting the cavities, the dielectric resonators and the supports therefor and the moving tuning elements. Indeed, the mutual dimensional changes of all these elements can considerably influence the resonance frequency of said filters and resonators.

BRIEF SUMMARY OF THE INVENTION

Accordingly the purpose of the present invention is to overcome the above mentioned drawbacks and indicate an electrically efficient tunable microwave resonator of low cost and at the same time having great thermal and mechanical stability.

To achieve these purposes the object of the present invention is a tunable microwave resonator as set forth in claims 1 through 8 The resonator which is the object of the present invention consists essentially of a preferably cylindrical hollow body in which is inserted a cylindrical dielectric resonator (DR) rigidly connected to a tuning screw by means of a support having low dielectric constant placed between the screw and the dielectric resonator as a spacer. The tuning screw penetrates by screwing into a hole made in a wall of said hollow body with no need of introduction in the cavity thereof. On the edge of the hole the wall exhibits a toroidal extension toward the interior of the cavity, whose outside diameter is normally greater than that of the dielectric resonator placed in front but it can also be slightly smaller. The change of tuning is achieved by rotating the tuning screw in one direction or the other with preference for the direction in which the dielectric resonator approaches said toroidal extension.

The tunable resonator is also provided with means of exciting in the cavity one or more resonant modes of an electromagnetic field and taking the currents generated from the resonant modes of said field to transfer them to an active element of a microwave oscillator.

The second object of the present invention is a microwave filter achieved by coupling together a predetermined number of tunable microwave resonators similar to that which is the object of the present invention, as set forth in claims 9 through 15. In the filter in question the cavities of said resonators are achieved in a body of metal or dielectric material taken as the basic part for machining of the filter and have a quite general arrangement. Coupling between the cavities is achieved by means of holes which traverse completely the walls separating the cavities from each other and putting them in communication. Two of said holes made in two ends of the filter constitute, without distinction, an input port for a microwave signal to be filtered and having a centre band frequency in the tuning range of the filter, or an output port of the filter at which is available a filtered signal.

The third object of the present invention, as set forth in claim 16 is a first variant of the filter of the more general case in which the cavities are identical cylindrical cavities arranged with the respective cylindrical symmetry axes mutually parallel and lying in the same plane. The holes in the separating walls between the cavities or communicating with the exterior are aligned along an axis passing through the centres of the cylindrical cavities.

The fourth object of the present invention is a second variant made in the filter of the more general case, as set forth in claim 17. The variant which is the object of the present invention consists of the fact that the cavities of a first group have their axes of cylindrical symmetry mutually parallel and lying in a common plane and the cavities of a second group have their cylindrical symmetry axes mutually parallel and lying in a common plane perpendicular to the above. The couplings between the cavities are achieved by means of holes made in the dividing walls between the cavities or with the exterior.

A microwave filter comprising dielectric resonators can also be provided by utilising a rectangular wave guide whose cross section has dimensions such that the critical frequency of the guide is higher than the resonance frequency of the dielectric resonators used.

Therefore, the fifth object of the present invention is a third variant made to the filter of the more general case, as set forth in claim 18 in which the microwave filter is provided by means of a rectangular wave guide. In said guide are inserted cylindrical dielectric resonators connected to positioning and tuning means similar to those used in the tunable microwave resonator which is the object of the present invention. The guide is closed at both ends by walls having an opening in their centre and said opening constituting an input port of the filter for a microwave signal to be filtered or, without distinction, an output port of the filter for a filtered signal.

The resonators and all the microwave filter types which are the object of the present invention are compact and of great construction simplicity, and hence easy to miniaturise, and exhibit furthermore the basic advantage of possessing great temperature stability achieved without the use of sophisticated and costly manufacturing materials.

Another advantage is due to the fact that different means of positioning the DRs in the respective cavities and changing the tuning thereof are no longer necessary because in the tunable resonators and filters which are the object of the present invention it is the means used to change tuning or syntonisation which support the respective DRs. Said means are such that they confer mechanical stability on the DRs while allowing movement.

BRIEF DESCRIPTION OF THE DRAWINGS

Further purposes and advantages of the present invention are clarified in the detailed description of an embodiment thereof given below by way of nonlimiting example with reference to the annexed drawings wherein:

FIG. 2 shows a cross section view along plane of cut 2—2 of the tunable resonator of FIG. 1 to make clear the respective tuning device.

FIG. 3 shows a top view of a microwave filter including several tuning devices similar to those of FIG. 2, FIG. 4 shows a partial cross section view along plane of cut 4—4 of the filter of FIG. 3, FIG. 5 shows a top view of a second embodiment of the microwave filter of FIG. 3, and FIG. 6 shows a partial axonometric view, partially in longitudinal half section, of a second microwave filter provided in a rectangular wave guide and including several tuning devices similar to those of FIG. 2.

DETAILED DESCRIPTION OF THE PREFERRED EMBODIMENTS

Figure 1:
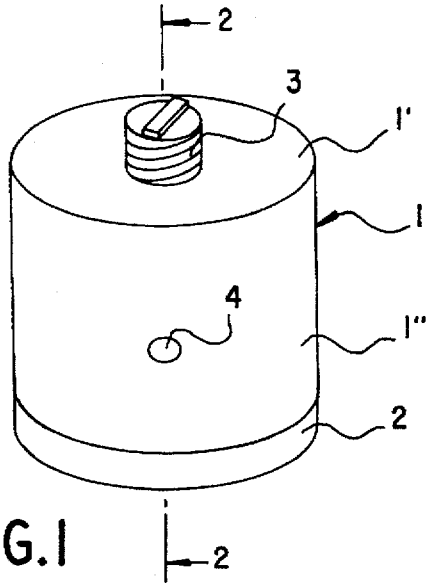
FIG. 1 shows an axonometric view of the tunable resonator for microwave oscillators which is the object of the present invention.

With reference to FIG. 1, reference number 1 indicates a hollow cylindrical metal body with bottom closed by a metal plate 2. In the cylindrical cavity of the body 1 is located a cylindrical dielectric resonator, not visible in FIG. 1, connected to a metal tuning screw 3 which screws into a hole made in the flat upper wall 1' of the body 1 from which it emerges. In the cylindrical side wall 1" of the body 1 is made a hole 4 in which penetrates a probe, not visible in the figures, capable of exciting in the cavity one or more resonant modes of an electromagnetic field.

With reference to FIG. 2, in which the same elements of FIG. 1 are indicated by the same symbols, 5 indicates the cavity of the cylindrical body 1, and 6 indicates the dielectric resonator located in the cavity 5. The latter is a high dielectric constant resonator of known type whose resonance frequency is 18.7 GHz in the basic resonant mode of electrical type $TE_{01\delta}$. The end of the tuning screw 3 is rigidly connected to a first end of a cylindrical dielectric support 7, having a low dielectric constant, and whose second end is rigidly connected to the central zone of a flat face of the cylindrical dielectric resonator 6. The screw 3, the cylindrical dielectric resonator 6 and the cylindrical dielectric support 7 are aligned along a common symmetry axis coinciding with the cylindrical symmetry axis of the metal body 1 and the hole in the flat upper wall 1' indicated by F. The flat upper wall 1' exhibits on the edge of the hole F a toroidal extension 8 toward the inside of the cavity 5. The outside diameter of the toroidal extension 8 is normally greater than the diameter of the cylindrical dielectric resonator 6 but can be equal or even slightly smaller. The inside diameter is of course that of the hole F.

The toroidal extension 8 extends into the cavity 5 for a length approximately between a fifth and a third but preferably a fourth of the internal height of the cavity 5.

The rigid connection between the cylindrical dielectric support 7, the metal tuning screw 3 and the cylindrical dielectric resonator 6 is provided by gluing of the two ends of the cylindrical dielectric support 7 or, as an alternative, by means of a thin screw of dielectric material traversing axially the cylindrical dielectric resonator 6 and the cylindrical dielectric support 7 and terminating in the body of the metal tuning screw 3 where it screws in.

Figure 2A:
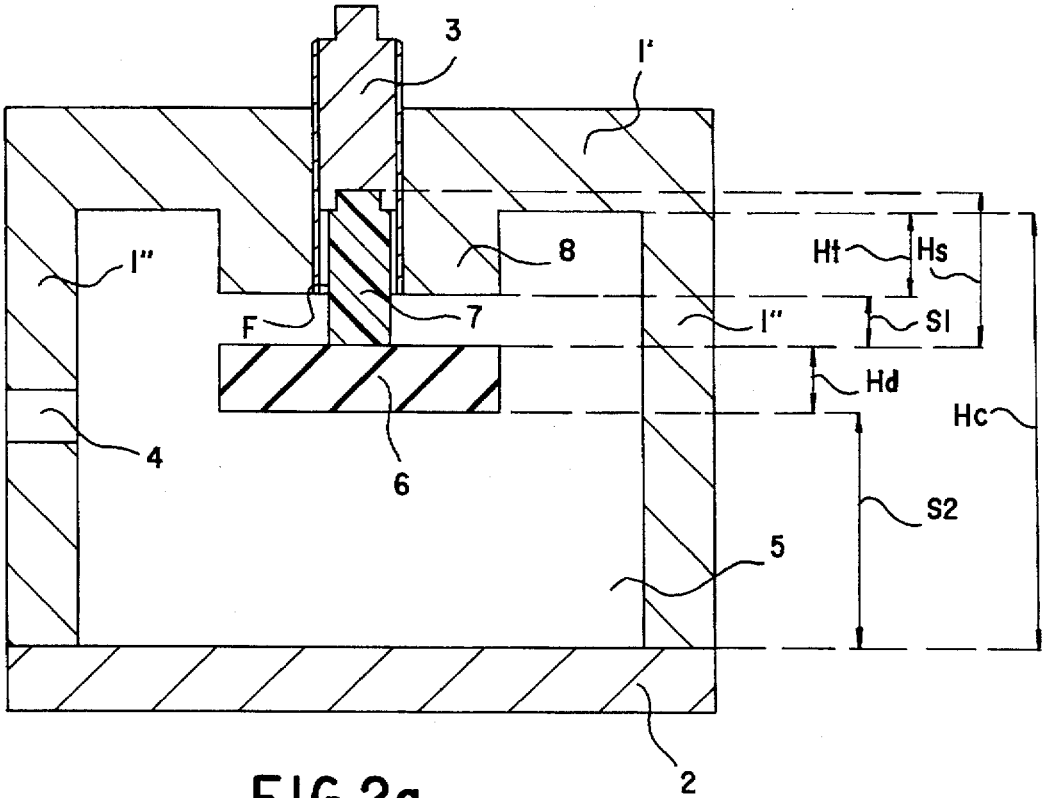
FIG. 2*a* shows the cross-section of FIG. 2 marked to indicate the support and the resonator as made of dielectric material.

In a first alternative embodiment (see FIG. 2*a*) of the tunable resonator of FIGS. 1 and 2, the toroidal extension 8 is replaced by a cylinder of dielectric material drilled in the centre and glued to the flat upper wall 1' in the cavity 5 in such a way that the hole F coincides with the central hole of the drilled dielectric cylinder. The material of which said cylinder is made is in general of the same type as that used for the cylindrical dielectric resonator 6.

Figure 2B:
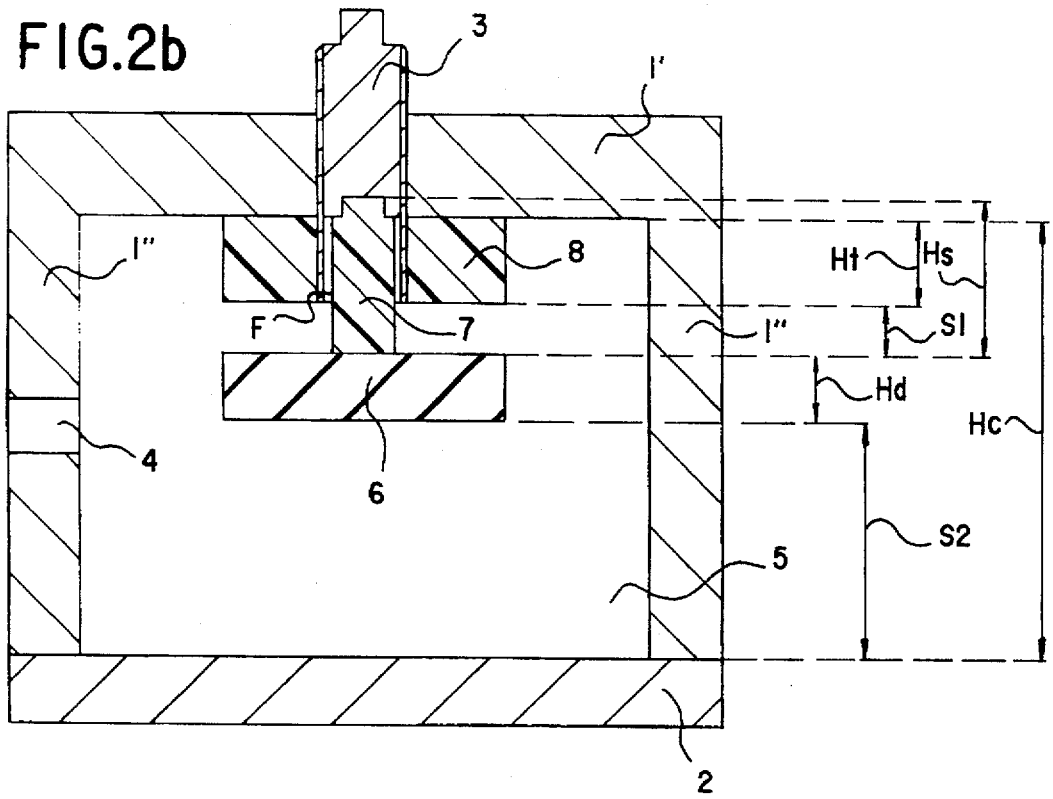
FIG. 2*b* shows the cross-section of the toroidal extension and the resonator marked as made of dielectric material.
Figure 2C:
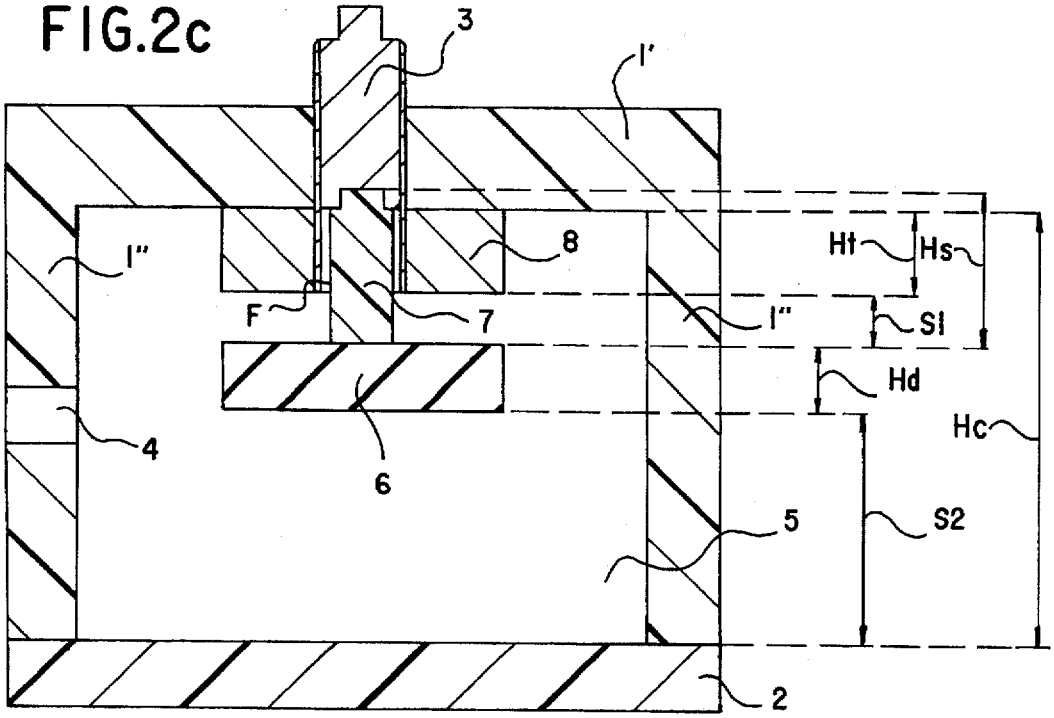
FIG. 2*c* shows the chamber walls, the support, and the resonator marked as made of dielectric material.

In a second alternative embodiment (see FIG. 2*b*) of the tunable resonator of FIGS. 1 and 2, the body 1 and the closing plate 2 are of dielectric material and in this case even The toroidal extension 8 is of the same material as the dielectric wall 1'.

In a third alternative embodiment (see FIG. 2*c*) in which the body L and the metal closing plate 2 are of dielectric material The toroidal extension 8 is replaced by a metal cylinder drilled in The centre and glued to dielectric wall 1' in the cavity 5 so that the hole F coincides with the central hole of the drilled metal cylinder.

FIG. 2 also shows the geometric parameters as for example distances and heights which will be useful in the discussion of operation given below. Specifically S2 indicates The distance of the lower face of the DR 6 to The internal surface of the cavity 5 belonging to the closing cover 2. Hd indicates The height of the DR 6, Ht the height of the toroidal extension 8 and Hs the height of the dielectric support 7. The symbol S1 indicates the distance of the upper face of the DR 6 from the toroidal extension 8 and Hc indicates the internal height of the cylindrical cavity 5.

Operation of the tunable resonator is now discussed with reference to FIGS. 1 and 2. As a first step for the analysis it is useful to know a law of dependence of the resonance frequency fr of the cylindrical dielectric resonator 6 on the physical and geometrical parameters thereof and of the cavity 5 which receives it. It should be noted that the hole F is not part of the cavity 5 and that therefore the value of Ht must be relatively small to avoid undesired resonance in the hole, especially when the metal tuning screw 3 is in the position corresponding to the upper limit of the tuning range.

A problem similar to that set forth above is carefully analysed in the volume entitled 'DIELECTRIC RESONATORS' by Darko Kajfez and Pierre Guillon published by ARTECH HOUSE INC., 1986. Formula 1.1 on page 3 of this volume gives an approximate relationship for the fr, with reference to a model which exemplifies an insulated cylindrical dielectric resonator. From this formula it can be seen that the fr depends principally on the geometrical dimensions of the DR and the dielectric constant of the material making it up. It is thus possible to obtain DRs with a desired ft. In chapters 4 and 5 of said volume, pages 113 to 241, are shown more sophisticated models from which it is possible to appraise the further effect on the fr of the proximity of metal or dielectric walls. From the analysis emerges the fundamental datum that the resonance frequency fr of a dielectric resonator increase in a non-linear manner with the approach of the latter to a wall. FIG. 4.19 on page 163 of the volume mentioned, shows this trend of fr as a function of the reciprocal distance between a DR and a metal tuning plate introduced in the resonating cavity housing the DR. The figure shows a very slow increase of fr for large distances until it reaches a certain distance at which said increase undergoes a considerable acceleration. The Q-factor of the resonator has the opposite trend and shows high values for long distances until reaching a certain distance at which it falls very fast with decreasing distance. From these considerations it is concluded that it is non advisable to bring the DR too close to a metal wall for the purposes of broadening the tuning range. The choice of the distance range must fall in a zone in which the fr varies rapidly enough and at the same time the Q-factor does not undergo significant changes. In view of the foregoing, in the case of the example, the smallest resonance frequency fr is obtained with the DR 6 near the centre of the cavity 5. In this case the height Hs of the dielectric support 7 is such that the end of the tuning screw 3 does not penetrate in the cavity 5 but can penetrate in the central zone of the toroidal extension 8, with said zone coinciding with the threaded hole F. Starting from this initial arrangement of the DR 6 a rotation of the screw 3 in one direction or the other causes translation of the DR towards one of the two walls, upper or lower, of the cavity 5 causing in either case an increase of the ft. During the tuning operation the value Hc–Hd–Ht corresponding to the sum of the distances S1+S2 remains constant.

It is surely preferable to implement the tuning in such a manner that rotation of the screw 3 causes a gradual emergence of said screw from the hole F, i.e. with S1<S2, and in this case the influence of the dissipating material represented principally by the screw 3, and to a lesser extent by the cylindrical dielectric support 7, on the fr and on the resonant modes of the dielectric resonator 6 is quite small. The mechanical stability of the structure is also improved.

The above remarks apply also if the form of the cavity 5 is other than cylindrical. But the forms which exhibit at least one axis of symmetry along which the cavity has a constant section are preferred and in these cases the above axis of symmetry coincides with that of the different elements of the tuning device. The resonator of FIGS. 1 and 2 is also tunable when in the cavity 5 are excited resonant modes different from the basic one $TE_{01\delta}$.

The advantages of the tunable resonator of FIGS. 1 and 2 are now reconsidered to give a justification of them on the basis of the considerations made.

In view of the foregoing remarks on the compactness of the structure which prepares for miniaturisation, the characteristic appears evident from the construction simplicity of the resonator. As may be seen from the figures, the moving part of the tuning device comprises only a screw and a spacer since the toroidal extension 8 is part of the cylindrical body 1. The special support means for the dielectric resonator 6 in the cavity 5 are no longer necessary because it is the moving part itself of the tuning device which fulfils this function.

In view of the above remarks concerning the drastic reduction of the mechanical vibrations set up in the structure of the resonator during particularly severe conditions of employment, it is achieved by the fact that throughout the tuning range the dielectric resonator 6 is contained in a half-part of the cavity 5 delimited by the wall 1'. In this case the length of the moving unit consisting of the tuning screw 3 and the dielectric support 7 is small. In addition, the toroidal extension 8 gives an extended side constraint to the above mentioned moving unit and prevents its vibration.

In view of the above remarks concerning the low dependency of resonance frequency fr on temperature changes, said behaviour is the consequence of the fact that the distance S1 on which mainly depends resonance frequency fr does not change with temperature, due to a kind of compensation which takes place between the different thermal expansions which influence S1. For this purpose it should be stated that the expansions of the walls 1' and 1" of the cavity produce a rigid translation of the unit consisting of the metal tuning screw 3, the dielectric support 7 and the DR 6 which does not change S1. As concerns the tuning device, expansion of the dielectric support 7 produces a slight lowering of the DR 6 and consequently an increase in S1 which is compensated by the decrease in S1 caused by expansion of only the part of the toroidal extension 8 of length Hs–S1. Said compensation can be optimised by choosing appropriately the materials which make up the dielectric support 7 and the walls of the cavity 5, or the drilled cylinder which replaces the toroidal extension 8 in those cases of alternative embodiments described above. For this purpose the choice must fall on those materials which have thermal expansion coefficients best suited to achieving said optimisation.

With reference to FIG. 3 there is seen a microwave filter consisting of a metal body 9 of a form similar to a parallelepiped having in it four identical cylindrical cavities 10 aligned along an axis perpendicular to the axes of cylindrical symmetry of said cavities and passing near the centres thereof. The cylindrical cavities 10 house respective identical cylindrical dielectric resonators not shown in the figures. The upper wall of the metal body 9 is drilled opposite the centre of the cylindrical cavities 10 for passage of as many metal tuning screws 3. The cylindrical cavities 10 are placed in electromagnetic communication with each other by means of holes 11, termed irises, made within the walls which divide the cavities. The holes 11 are aligned along said axis of alignment of the cylindrical cavities 10. On said axis are also aligned two holes 11' and 11" made in respective walls placed at the two ends of the filter. Each of these constitutes an input port for a microwave signal to be filtered and having a centre band frequency in the tuning range of the filter or, without distinction, an output port of the filter at which is available a filtered signal.

In the holes 11, 11' and 11" are visible threaded pins 12 used to adjust, in a known manner, the electromagnetic couplings between adjacent cylindrical cavities 10 and between the input and output ports and the external devices.

With reference to FIG. 4, in which the same elements as in FIG. 3 are indicated by the same symbols, it is noted that the metal body 9 of the filter is in reality made up for construction exigencies of to parts 9 and 9' rigidly connected together by means of screws not visible in the figures. The cylindrical cavities 10 are completed in the two half-parts 9 and 9' while the holes 11, 11' and 11" are made by milling which involves only the part 9. The tuning screws 3 penetrate in the holes F of the upper wall of the metal body 9 and are rigidly connected to dielectric resonators 6 placed in cavities 10 by means of the dielectric supports 7. The internal walls of the cavities 10 have a toroidal extension 8 at the edge of the holes F. The numbers which indicate the tuning screws, the dielectric supports, the dielectric resonators and the toroidal extensions coincide purposely with those of the analogous elements of the tunable resonator of FIG. 2, because said elements have the same electrical and geometrical characteristics and therefore all the discussion made above applies also to the filter.

In operation, at the input port of the filter is made to arrive a signal to be filtered having a certain band range, said signal traverses the cavities 10 which have an electromagnetic resonance in the mode $TE_{01\delta}$at the frequency of 18.7 GHz, which corresponds to the resonance of the DRs contained therein. Because of said resonances and the couplings between the cavities there is made a frequency selection which limits the band width around the frequency of 18.7 GHz of the signal present at the output port of the filter. During designing of the filter of FIGS. 3 and 4 it is possible to choose some geometrical parameters which influence the mutual couplings between the cavities or between these and the input and output ports as for example the dimensions of the irises 12 in order to obtain a frequency response of the pass-band type approximating very well the form of a desired response. In the case in question, the pass-band response obtained approximates a Chebyshev function of the 4th order having a central frequency fo of 18.7 GHz, band width of 50 MHz, and band undulation factor of 0.1 dB.

The operation of alignment between the centre band frequency fo of the filter and the centre band frequency of the input signal is done by turning the metal tuning screw 3. For this purpose, starting from an initial condition in which =he centre band frequency fo of the filter takes on the minimum value of 18.7 GHz, progressive extraction of the zoning screws 3 from their holes F produces an equally progressive increase in the frequency fo until a value of 19 GHz is reached.

With reference to FIG. 5 there can be noted a microwave filter consisting of a metal body 13 in which are made four identical cylindrical cavities 14, 15, 16 and 17. Specifically the cavities 14 and 15 are aligned along a first axis and the cavities 15, 16 and 17 are aligned along a second axis perpendicular to the first. The two axes are perpendicular to the cylindrical symmetry axes of all the cavities and pass near the centres of the respective cavities.

The cavities 14, 15. 16 and 17 house the respective cylindrical dielectric resonators which are identical but not visible in the figure. The upper wall of the metal body 13 is drilled opposite centre of said cavities for passage of as many metal tuning screws 3 rigidly connected to the dielectric resonators in the cavities by means of dielectric supports not shown in the figure. The internal walls of the cavities 14, 15, 16 and 17 exhibit a toroidal extension, not shown in the figure at the edge of the holes in which penetrate the metal tuning screws 3. As concerns the electrical and geometrical characteristics of the screws 3, dielectric resonators, dielectric supports and toroidal extensions, they are identical to those of the analogous elements of the tunable resonator of FIG. 2, and therefore are indicated by the same symbols and all the remarks made above continue to apply.

The cavity 14 is placed in electromagnetic communication with the cavity 15 by means of a hole 18, termed also iris, made in the wall of the body 13 which separates the cavity 14 from the cavity 15. Said cavity is placed in communication with the outside of the filter through a hole 18'. The holes 18 and 18' are aligned along said first axis which passes through the centres of the cylindrical cavities 14 and 15. The cavity 16 is placed in electromagnetic communication with the cavities 15 and 17 by means of holes 19, termed also irises, made in the walls of the body 13 which separate the cavity 16 from the cavities 15 and 17. The cavity 17 is placed in communication with the outside of the filter by means of a hole 19'. The holes 19 and 19' are aligned along said second axis which passes through the centres of the cylindrical cavities 15, 16 and 17. As may be seen from the figure, the axes of the holes 18 and 19 which involve the cavity 15 are arranged at right angles with each other.

The holes 18' and 19' which communicate with the outside of the filter constitute an input port for a microwave signal to be filtered having a centre band frequency in the tuning range of the filter or, without distinction, an output port of the filter at which is available a filtered signal.

Similarly to what was said for the filter of FIGS. 3 and 4, also for the filter of FIG. 5 the metal body 13 is in reality made up, for construction exigencies, of two half-parts not shown in the figures and rigidly connected together by screws. Consequently the cavities 14, 15, 16 and 17 and the holes 18, 18', 19 and 19' are completed in the two half-parts. There are also provided threaded pins which penetrate into said holes, not shown for the sake of simplicity, used to adjust in a known manner the electromagnetic couplings between adjacent cavities and between input and output ports and external devices. The frequency response is the same as that of the filter of FIG. 3 just as the alignment operations of the centre band frequency fo are analogous.

The microwave filter variant shown in FIG. 5 exhibits, as compared with the filter of FIGS. 3 and 4, the additional advantage due to the low level of disturbances outside the band. As is known, when in a cavity there are used dielectric resonators, in said cavity are excited, in addition to the basic resonant mode, some modes typical of dielectric resonators. The latter are hybrid resonant modes, i.e. not completely TE or TM, and generally appear at higher, but also lower, frequencies than that of the basic resonant mode. In the filters of FIGS. 3 and 5, for example, the hybrid resonant modes exhibit a maximum at a frequency $f_H$ which can be from 1 to 4 GHz from the centre band frequency fo. The frequency response of said filters is a function which varies continuously between the value taken on at the centre band frequency fo and that at the frequency $f_H$. From measurements performed on the filters of FIGS. 3 and 5, the distance of $f_H$ to fo proved to be equal in both cases. However, while for the filter of FIG. 3 the power of the hybrid mode measured at $f_H$ compared with the power of the basic mode measured at fo is attenuated by approximately 20 dB, the analogous attenuation is 60 to 70 dB for the filter of the variant of FIG. 5. Analysing the frequency spectrum of the two filters it can also be seen that in all the zone outside the band the level of disturbances of the filter of FIG. 5 remains constantly lower than 40 to 50 dB in comparison with the level of disturbances of the filter of FIG. 3.

The remarks made for the filters of FIGS. 3 and 5 remain applicable also in the case where the form of the respective resonant cavities is other than cylindrical. But the preferred forms are those which exhibit at least one axis of symmetry along which the cavities retain a constant cross section and in these cases the above said axis of symmetry coincides with that of the different elements of the tuning devices.

With reference to FIG. 6 we note a microwave filter consisting of a section of rectangular wave guide 20 closed at both ends by walls 21, each having in the central zone an opening 22 which constitutes an input port for a microwave signal to be filtered having a centre band frequency in the tuning range of the filter, or without distinction, an output port of the filter at which is available a filtered signal. For construction exigencies the rectangular wave guide 20 consists of two parts 20' and 20" of which the part 20" is a bottom closing cover. The upper wall of the guide 20 exhibits threaded holes along the centre line in predetermined positions for introduction of metal tuning screws 3 to which are connected cylindrical dielectric resonators 6 by means of dielectric supports 7. The numbers indicating the above said elements coincide purposely with those of the analogous elements of the tunable resonator of FIG. 2, because the elements have the same electrical and geometrical characteristics and therefore all the remarks made above continue to apply even in the case of the filter. There are also provided threaded pins which penetrate in the cavity of guide 20 in the space between the DRs 6 (not shown for the sake of simplicity) used to adjust in a known manner the electromagnetic couplings between the dielectric resonators and the guide.

For the purposes of correct operation of the filter it is essential to choose a rectangular wave guide with a cross section having dimensions such that the cut-off frequency of the guide is higher than the resonance frequency fr of the dielectric resonators used.

During designing it is possible to choose some geometrical parameters which influence the couplings, such as for example the distance between the resonators, to obtain a frequency response identical to that of the filters of FIGS. 3 and 5. The operation of alignment of the frequency fo is also identical.

The filter of FIG. 6 possesses as compared with the above filters greater construction simplicity but, on the other hand, attenuation of disturbances outside the band is poorer. In this case the highest hybrid resonant mode is only 1 GHZ from the centre band frequency.

The filters of FIGS. 3, 4, 5 and 6 can also be obtained by means of all the embodiments described for the tunable resonator of FIGS. 1 and 2. In particular, the toroidal extensions 8 can be replaced by drilled cylinders of dielectric material glued to the respective metal walls. The metal bodies 9 and 9', 13, and the rectangular wave guide 20 can be replaced by analogous dielectric material bodies, and the toroidal extensions 8 can consequently be of the same material as the dielectric walls, or replaced by metal cylinders drilled in the centre and glued to the dielectric walls.

Regardless of the various embodiments, another advantage common to all the filters in question is that of holding constant the band width and the form of the frequency response for the entire tuning range. At first glance it might seem that the opposite would be true. Indeed, it is known that the highest coupling possible between the resonant mode in a DR and the resonant mode in a cylindrical cavity, or in a guide used below its cut-off frequency, is obtained when the DR is positioned in the centre of the guide or cavity. Every shift from this position causes a reduction of the coupling which involves consequently a change in band width and in the form of the frequency response. In the resonator and filters in question the result is that the highest coupling is had for frmin—18.7 GHz, i.e. with the DRs in the centre of the respective cylindrical cavities of the guide 20 and the lowest coupling is had at frmax—19 GHz.

Nevertheless it has been shown experimentally that in filters in question, by choosing appropriately the values of %he heights Ht, Hd and Hc, the variation in the couplings does influence significantly the filter band. The values chosen must in any case keep unchanged the advantages explained above for the tunable resonator of FIG. 2, and at the same time must cause the DRs to be positioned nearly in the central zones of the respective cavities, or the guide 20, throughout the tuning range. This last condition means that S1+Ht≅S2.

It is possible to satisfy all the above conditions by choosing a cavity with internal height Hc not much greater if compared with the other geometrical parameters in play. As concerns the value of Ht it must be indicatively between one-fifth and one-third of the value of Hc and preferably one-fourth. It is useful at this point no summarise the advantages directly due to the presence of the toroidal extension 8 in the resonator and the filters in question. A first advantage is due to the neutralisation of the thermal effects on the fr of the resonator and on the fo of the filters. A second advantage is due to the stabilising effect shown during the tuning operation on the band width of the filters and on the form of the frequency response thereof. And lastly, a third advantage is represented by the obstacle placed against the rise of harmful vibrations in the moving tuning device during uses characterised by strong stresses.

We claim:

1. A tunable microwave resonator, comprising:

walls delimiting a cavity, said walls including a first wall formed with an opening;

a tuning screw extending in said opening, a cylindrical dielectric resonator disposed in said cavity, and a dielectric support projecting in said opening, said dielectric support acting as a spacer and rigidly connecting said dielectric resonator to said tuning screw;

said cavity and said dielectric resonator being exciteable to one or more resonant modes of an electromagnetic field, wherein a current induced by the resonant modes is transfered outside said cavity;

and a toroidal extension formed on said first wall inside said cavity and surrounding said opening, said toroidal extension extending a given length inside said cavity, said toroidal extension reducing a thermal effect on the resonance frequency, and increasing a mechanical stability.

2. The tunable microwave resonator according to claim 1, wherein said walls further include a second wall extending parallel to and at a given distance from said first wall and wherein said cylindrical dielectric resonator has a given diameter, said toroidal extension having an outside diameter approximately equal to said given diameter of said cylindrical dielectric resonator, and said length of said toroidal extension being between one-fifth and one-third of said given distance between said first and second walls.

3. The tunable microwave resonator according to claim 1, wherein said length of said toroidal extension is one-fourth of said given distance.

4. The tunable microwave resonator according to claim 1, wherein said dielectric support has a length defining an initial position of said tuning screw wherein the resonance frequency is at a minimum, said cylindrical dielectric resonator is positioned substantially centrally in said cavity, and an end of said tuning screw does not penetrate into said cavity.

5. The tunable microwave resonator according to claim 1, wherein said cylindrical dielectric resonator has an axis of cylindrical symmetry, and a rotation of said tuning screw causing a small translatory motion of said resonator along said axis of cylindrical symmetry, substantially about a central position thereof within said cavity between said first and second walls, between a position defining a minimum frequency of a tuning range of the tunable microwave resonator and a maximum frequency thereof.

6. The tunable microwave resonator according to claim 1, wherein said walls are metallic and said toroidal extension is formed of dielectric material with a relatively high dielectric constant, and said toroidal extension is rigidly connected to said first wall.

7. The tunable microwave resonator according to claim 1, wherein said walls are formed with dielectric material, said toroidal extension is formed with metallic material, and said toroidal extension is rigidly connected to said first wall.

8. The tunable microwave resonator according to claim 1, wherein said dielectric support and said toroidal extension are formed of materials having respective thermal expansion coefficients such that a thermal elongation thereof is approximately equal.

9. The tunable microwave resonator according to claim 1, wherein said cavity is a cylindrical cavity.

10. A microwave filter, comprising:

a hollow body formed with walls defining a plurality of resonant cavities disposed in mutual succession, said walls including a first wall having first openings formed therein each leading into a respective one of said cavities;

tuning screws disposed in each of said first openings, said tuning screws each carrying a dielectric support and a dielectric resonator disposed in each of said cavities, said dielectric supports acting as spacers and penetrating in said first openings;

said hollow body being formed with an input port for a microwave signal to be filtered, said input port being defined by a second opening leading into a first of said cavities, and with an output port for a filtered signal, said output port being defined by a third opening leading from a last of said cavities to an outside of said body;

said body further including dividing walls separating said cavities, said dividing walls each being formed with fourth openings electromagnetically coupling adjacent cavities; and toroidal extensions of said first wall surrounding said first openings, each said toroidal extension extending for a given length inside said respective cavity, said toroidal extensions reducing thermal effect on the bandpass central frequency, and increasing mechanical stability.

11. The microwave filter according to claim 10, wherein said body is formed of metallic material.

12. The microwave filter according to claim 10, wherein said body is formed of dielectric material.

13. The microwave filter according to claim 10, wherein said cavities have a given height, and said toroidal extensions have an outside diameter approximately equal to a diameter of said cylindrical dielectric resonators, and a length between one-fifth and one-third of the given height of said cavities.

14. The microwave filter according to claim 13, wherein said cylindrical dielectric resonators have a length one-fourth of the given height.

15. The microwave filter according to claim 10, wherein said dielectric supports each have a length defining an initial position of said respective tuning screw wherein the resonance frequency of said cavity is at a minimum, said cylindrical dielectric resonator is positioned substantially centrally in said cavity, and an end of said tuning screw does not penetrate into said cavity.

16. The microwave filter according to claim 10, wherein each said cylindrical dielectric resonator has an axis of cylindrical symmetry, and a rotation of said respective tuning screw causing a small translatory motion of said dielectric resonator along said axis of cylindrical symmetry, substantially about a central position thereof within said respective cavity, between a position defining a minimum frequency of a tuning range of the microwave filter and a maximum frequency thereof.

17. The microwave filter according to claim 10, wherein said hollow body is metallic and said toroidal extensions are formed with dielectric material having a relatively high dielectric constant, and said toroidal extensions are rigidly connected to said body.

18. The microwave filter according to claim 10, wherein said wherein said hollow body is formed of dielectric material, said toroidal extension is formed of metallic material, and said toroidal extension is rigidly connected to said hollow body.

19. The microwave filter according to claim 10, wherein said dielectric supports and said toroidal extensions are formed of materials having respective thermal expansion coefficients such that a thermal elongation thereof is approximately equal.

20. The microwave filter according to claim 10, wherein said resonant cavities are mutually identical cavities aligned along an axis perpendicular to respective axes of symmetry thereof and passing centrally therethrough; wherein said second, third, and fourth openings are aligned along the axis aligning said cavities; and wherein said first openings are formed in said body centrally into said resonant cavities.

21. The microwave filter according to claim 20, wherein said cavities are cylindrical cavities.

22. The microwave filter according to claim 20, wherein:

said resonant cavities are identical cavities;

said cavities including a first group of cavities aligned along a first axis extending perpendicularly to a symmetry axis of said cavities and passing centrally through said cavities of said first group;

said cavities including a second group of cavities aligned along a second axis extending perpendicularly to said first axis and perpendicularly to a symmetry axis of said cavities, said second axis passing centrally through said cavities of said second group;

one of said resonant cavities placed at a first end of said first group is said first of said resonant cavities;

one of said resonant cavities placed at a first end of said second group is said last of said cavities;

said first and second groups of cavities are contiguous;

a resonant cavity at a second end of said first group coincides with a resonant cavity at a second end of said second group;

said second opening is aligned along said first axis, said third opening is aligned along said second axis, and said fourth openings are respectively aligned along said first and second axes; and said first openings are formed centrally towards said respective resonant cavities.

23. The microwave filter according to claim 20, wherein said plurality of resonant cavities defines a single cavity corresponding to a cavity of a rectangular wave guide having a cross section of dimensions such that a cut-off frequency of said guide is higher than the resonance frequency of said dielectric resonators; and wherein said first openings are formed in correspondence with a centre line of a wall of the rectangular wave guide, while maintaining a predetermined mutual distance.

* * * * *